US010181687B1

(12) United States Patent
Peng et al.

(10) Patent No.: US 10,181,687 B1
(45) Date of Patent: Jan. 15, 2019

(54) CONNECTOR MODULE

(71) Applicant: F TIME TECHNOLOGY INDUSTRIAL CO., LTD., New Taipei (TW)

(72) Inventors: Chang-Lin Peng, New Taipei (TW); Xin-Fu Liu, New Taipei (TW); Yen-Hua Huang, New Taipei (TW); Chih-Hsuan Tung, New Taipei (TW)

(73) Assignee: F TIME TECHNOLOGY INDUSTRIAL CO., LTD., New Taipei (TW)

( * ) Notice: Subject to any disclaimer, the term of this patent is extended or adjusted under 35 U.S.C. 154(b) by 0 days.

(21) Appl. No.: 15/833,981

(22) Filed: Dec. 6, 2017

(51) Int. Cl.

| | |
|---|---|
| ***H01R 13/50*** | (2006.01) |
| ***H01R 24/38*** | (2011.01) |
| ***H01R 13/52*** | (2006.01) |
| ***H01R 13/40*** | (2006.01) |
| ***H01R 12/71*** | (2011.01) |
| *H01R 103/00* | (2006.01) |

(52) U.S. Cl.
CPC ..... *H01R 24/38* (2013.01); *H01R 12/716* (2013.01); *H01R 13/40* (2013.01); *H01R 13/50* (2013.01); *H01R 13/5205* (2013.01); *H01R 2103/00* (2013.01)

(58) Field of Classification Search
None
See application file for complete search history.

(56) References Cited

U.S. PATENT DOCUMENTS

| | | | | |
|---|---|---|---|---|
| 6,283,793 | B1 * | 9/2001 | Nakata | H01R 4/185 439/404 |
| 8,337,221 | B1 * | 12/2012 | Huang | H01R 9/034 174/113 R |
| 2002/0052141 | A1 * | 5/2002 | Hattori | H01R 13/5205 439/587 |
| 2012/0178317 | A1 * | 7/2012 | Skidmore | H01R 13/025 439/884 |
| 2013/0157505 | A1 * | 6/2013 | Sykes | H01R 9/05 439/578 |
| 2014/0302724 | A1 * | 10/2014 | Ono | H01R 13/4364 439/751 |
| 2018/0224622 | A1 * | 8/2018 | Han | G02B 7/02 |

* cited by examiner

*Primary Examiner* — Truc Nguyen
(74) *Attorney, Agent, or Firm* — Guice Patents PLLC

(57) ABSTRACT

A connector module includes a connector consisting of a housing, a main holder member, a waterproof gasket, a subsidiary holder member, a conductor element and a connection fitting, a conducting seat including a conducting board and a conducting terminal mounted to the conducting board for the connection of the connection fitting.

12 Claims, 10 Drawing Sheets

CONNECTOR MODULE

BACKGROUND OF THE INVENTION

1. Field of the Invention

The present invention relates to connector technology and more particularly, to a connector module, which comprises a conducting seat, and a connector connected to the conducting seat in a detachable and rotatable manner.

2. Description of the Related Art

With the continuous updating of technology, various types of new electronic products have been introduced to the market. At present, many electronic devices are designed for connection with other electronic devices by wired means for signal transmission therebetween. The wire connection is achieved through the mating between a male connector and a female connector.

Most conventional connectors are designed for mounting in a circuit board for signal transmission, enhancing connector stability and signal transmission reliability.

However, with continuous development of technology, the demand for electronic signal transmission is constantly changing. In addition to maintaining signal transmission stability and reliability, it is even more necessary to maintain the same requirements in different electronic environments or activities Therefore, the conventional connector designs also need continuous improvement, maintaining flexibility to meet different demands. In conventional designs, connectors are to be accurately and fixedly mounted to a circuit board. However, the use of a connector in an electronic product that must be fixedly mounted to a circuit board limits the design flexibility of the electronic product. An improvement in this regard is desired.

SUMMARY OF THE INVENTION

The present invention has been accomplished under the circumstances in view. It is main object of the present invention to provide a connector module, which comprises a conducting seat and a connector connected to the conducting seat in a detachable and rotatable manner to improve the reliability and applicability of the electronic product using the connector module.

To achieve this and other objects of the present invention, a connector module comprises a connector and a conducting seat. The connector comprises a housing that comprises an insertion hole axially cut through opposing front and rear ends thereof, a flange extended around an outer perimeter thereof and an engagement groove defined within the flange, a main holder member that is connected to the housing and comprises a connection barrel located at one end thereof and mounted in the insertion hole of the housing, an engagement block extended around the periphery thereof and accommodated in the engagement groove and an accommodation chamber defined therein, a waterproof gasket attached onto the connection barrel and squeezed in between the main holder member and the housing, a subsidiary holder member that is mounted in the accommodation chamber of the main holder member and comprises a center conductor hole axially cut through opposing front and rear end thereof and a connection tip located at the front end thereof, a conductor element that is inserted into the center conductor hole and comprises a split end portion located at a front end thereof and disposed in the connection tip, and a connection fitting connected to the connection tip of the subsidiary holder member to surround the connection tip. The conducting seat is adapted for the connection of the connector, comprising a conducting board and a conducting terminal mounted to the conducting board and adapted for the connection of the connection fitting. The conducting terminal is electrically coupled with the conducting board.

Other advantages and features of the present invention will be fully understood by reference to the following specification in conjunction with the accompanying drawings, in which like reference signs denote like components of structure.

DETAILED DESCRIPTION OF THE PREFERRED EMBODIMENT

Figure 1:
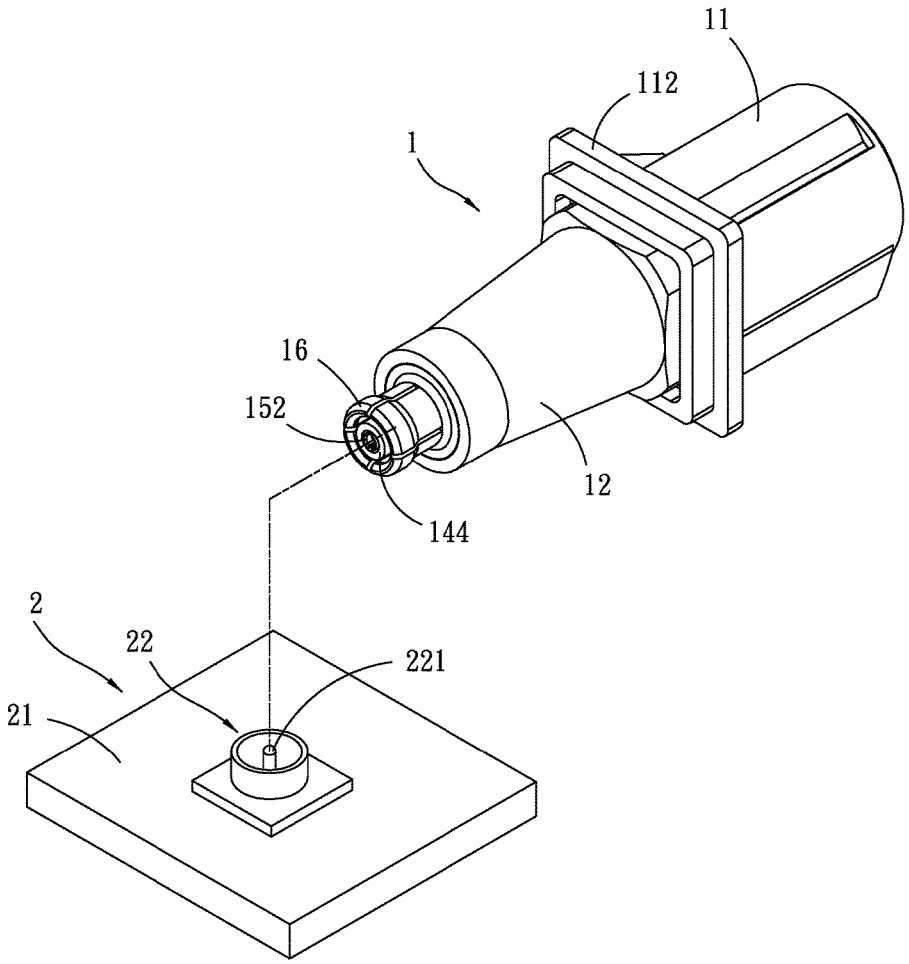
FIG. 1 is an elevational view of a connector module in accordance with a first embodiment of the present invention.
Figure 2:
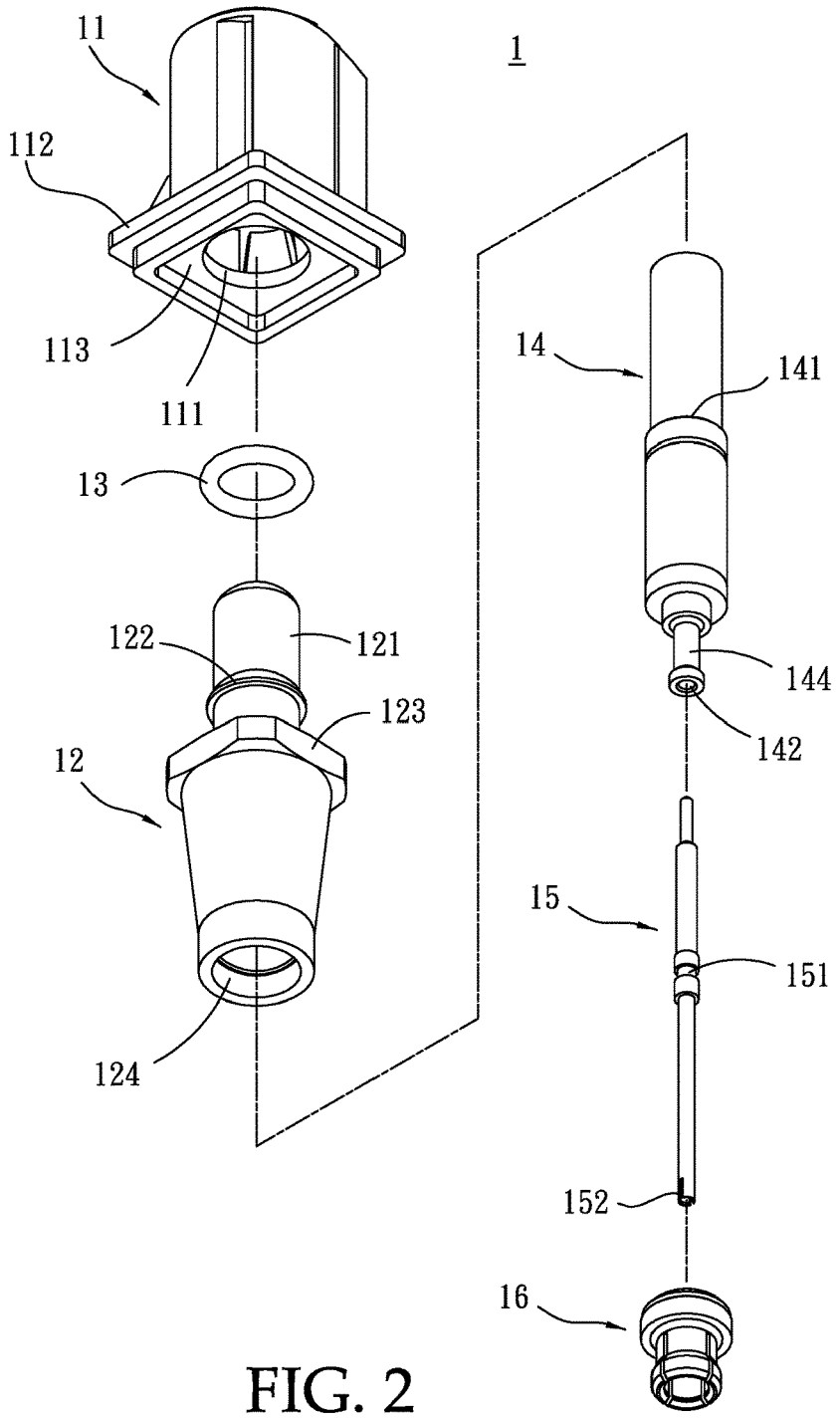
FIG. 2 is an exploded view of the connector module in accordance with the first embodiment of the present invention.

Referring to FIGS. 1 and 2, an elevational view and an exploded view of a connector module in accordance with a first embodiment of the present invention are shown. The connector module comprises a connector 1 and a conducting seat 2.

Figure 3:
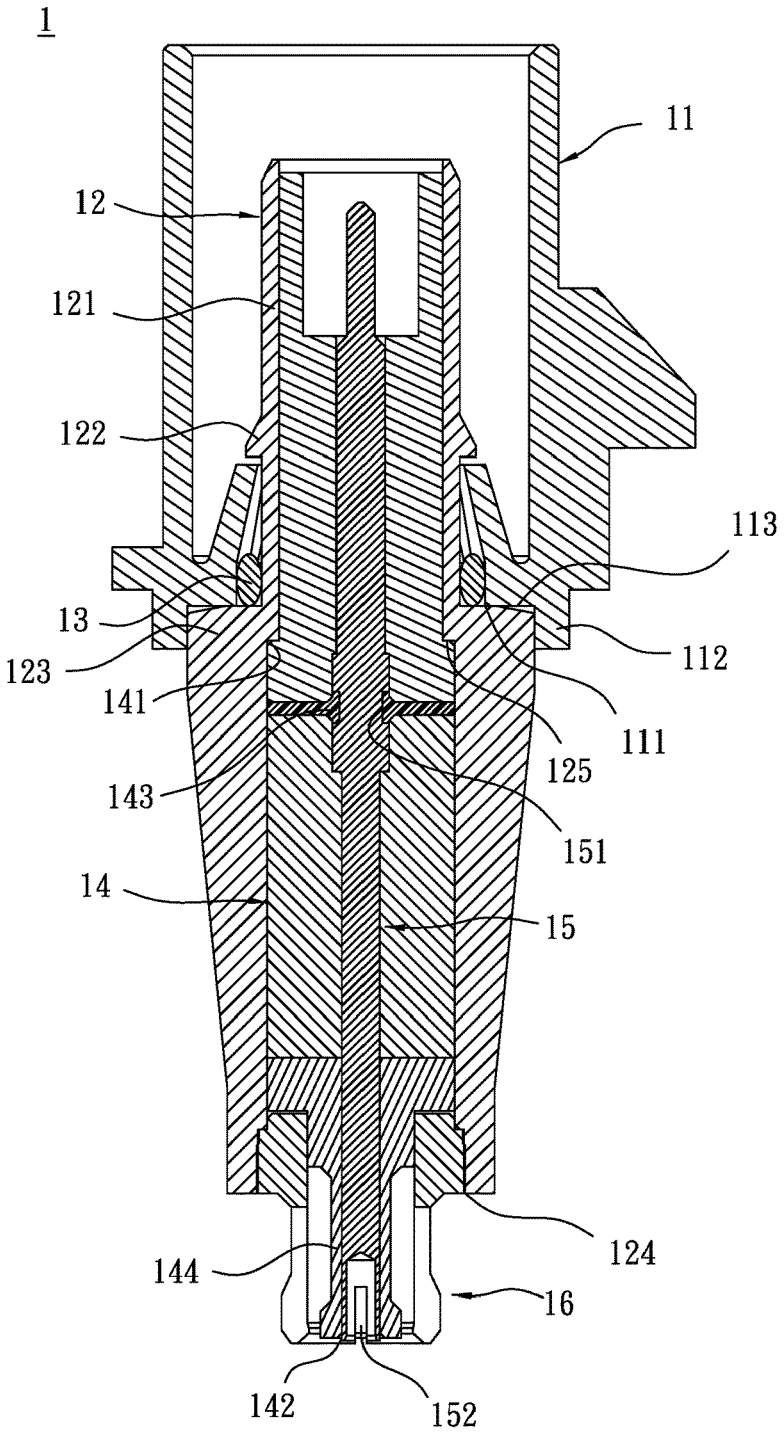
FIG. 3 is a sectional assembly view of the connector module in accordance with the first embodiment of the present invention.

The connector 1 comprises a housing 11. As illustrated in FIG. 2, the housing 11 comprises an insertion hole 111 axially cut through opposing front and rear ends thereof, a rectangular flange 112 extended around the outer perimeter of the front end thereof, and an engagement groove 113 defined within the flange 112. The connector 1 further comprises a main holder member 12 mounted in the housing 11. The main holder member 12 exhibits a hollow cylindrical shape, comprising a connection barrel 121 located at one end thereof and mounted in the insertion hole 111 of the housing 11, and an annular flange 122 extended around the periphery of the connection barrel 121. The connector 1 further comprises a waterproof gasket 13 attached onto the connection barrel 121. After insertion of the connection barrel 121 into the insertion hole 111, the waterproof gasket 13 is squeezed in between the main holder member 12 and the housing 11, as illustrated in the sectional assembly view of FIG. 3. The main holder member 12 further comprises an engagement block 123. After connection between the main holder member 12 and the housing 11, the engagement block 123 is engaged in the engagement groove 113 to secure the main holder member 12 and the housing 11 together. The main holder member 12 further defines therein an accommodation chamber 124, and a chamfer edge 125 in the accommodation chamber 124.

Referring to FIG. 2 again, the connector 1 further comprises a subsidiary holder member 14 mounted in the main holder member 12. The subsidiary holder member 14 is inserted into the accommodation chamber 124, comprising a positioning groove 141 extended around the periphery thereof. After insertion of the subsidiary holder member 14 into the main holder member 12, the positioning groove 141 is forced into engagement with the chamfer edge 125 to secure the main holder member 12 and the subsidiary holder member 14 together. The subsidiary holder member 14 comprises a center conductor hole 142 axially cut through opposing front and rear ends thereof, a locating seat 143 defined therein around the center conductor hole 142, as illustrated in the sectional assembly view of FIG. 3, and a tubular connection tip 144 extended from the front end thereof round the center conductor hole 142. The connector 1 further comprises a rod-like conductor element 15 inserted into the center conductor hole 142. The conductor element 15 comprises a retaining groove 151 extended around the periphery thereof and forced into engagement with the locating seat 143 to secure the conductor element 15 in the center conductor hole 142, and a split end portion 152 defined in the front end thereof and disposed in the connection tip 144. The connector 1 further comprises a connection fitting 16 connected to the connection tip 144 of the subsidiary holder member 14. The connection fitting 16 is a hollow seat member. After connection between the connection fitting 16 and the connection tip 144, the connection fitting 16 surrounds the connection tip 144, giving insulation protection.

Referring to FIG. 1 again, the conducting seat 2 comprises a conducting board 21, and a conducting terminal 22 mounted to the conducting board 21. In this embodiment, the conducting terminal 22 is a seat member electrically connected to the conducting board 21, having a conducting rod 221 disposed therein. The conducting terminal 22 is adapted for the connection of the connection fitting 16, enabling the conducting rod 221 to be inserted into the split end portion 152 to keep the connector 1 and the conducting seat 2 in conduction.

Figure 4:
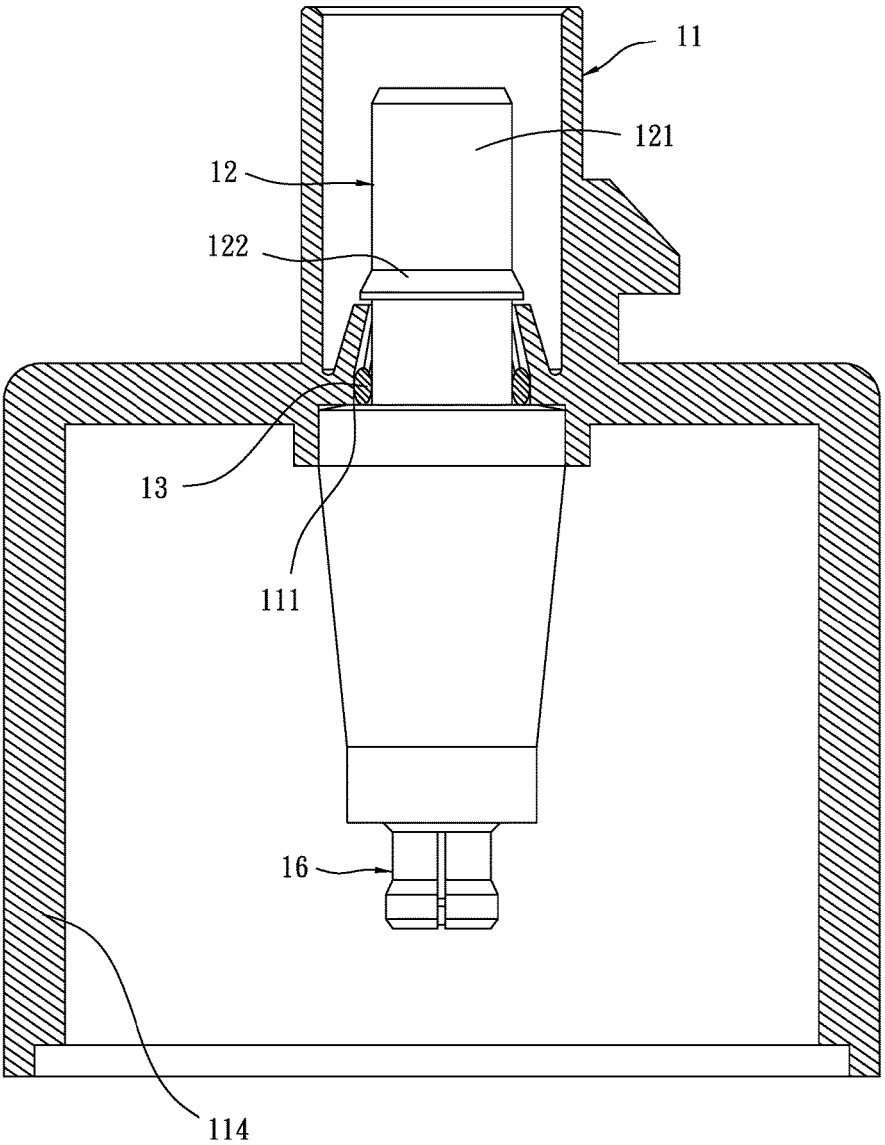
FIG. 4 is a sectional assembly view of a connector module in accordance with a second embodiment of the present invention.

Referring to FIG. 4, a connector module in accordance with a second embodiment of the present invention is shown. This second embodiment is substantially similar to the aforesaid first embodiment with the exception that the housing 11 further comprises a rectangular guard shell 114 connected to the flange 112. In this embodiment, the flange 112 and the rectangular guard shell 114 are made in integrity. The rectangular guard shell 114 surrounds the main holder member 12, giving protection to the main holder member 12.

Figure 5:
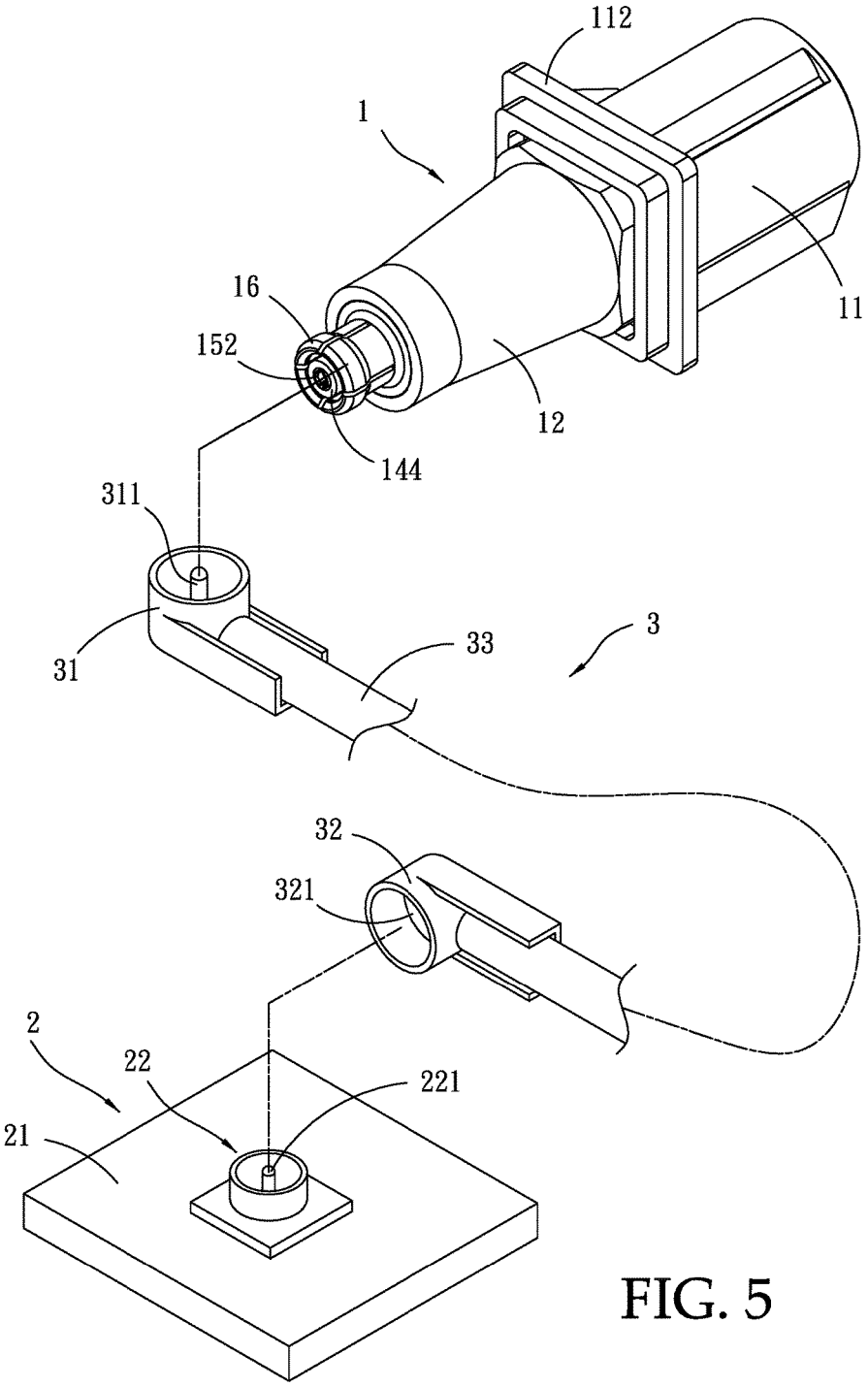
FIG. 5 is a schematic elevational view of a connector module in accordance with a third embodiment of the present invention.

Referring to FIG. 5, a connector module in accordance with a third embodiment of the present invention is shown. This third embodiment is substantially similar to the aforesaid first embodiment with the exception that the connector module further comprises an extension adapter 3. The extension adapter 3 comprises a first connector 31, a second connector 32, and an electrical wire 33 electrically connected between the first connector 31 and the second connector 32. The first connector 31 comprises therein a conducting rod 311. The first connector 31 is adapted for connection to the connection fitting 16, enabling the conducting rod 311 to be engaged into the split end portion 152 to keep the connector 1 and the extension adapter 3 in conduction. The second connector 32 defines therein a center conductor hole 321. After connection between the second connector 32 and the conducting terminal 22, the center conductor hole 321 accommodates the conducting rod 221. Through the extension adapter 3, the conduction distance between the connector 1 and the conducting seat 2 is extended.

Figure 6:
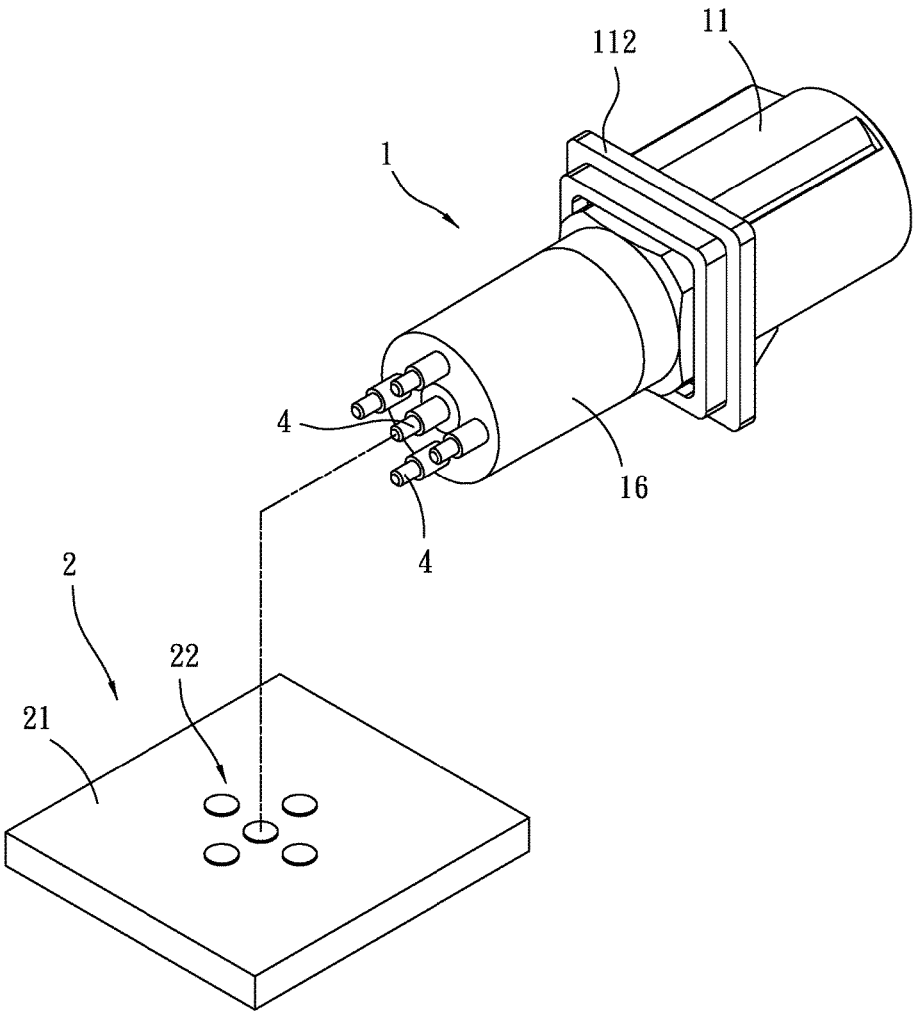
FIG. 6 is a schematic elevational view of a connector module in accordance with a fourth embodiment of the present invention.
Figure 7:
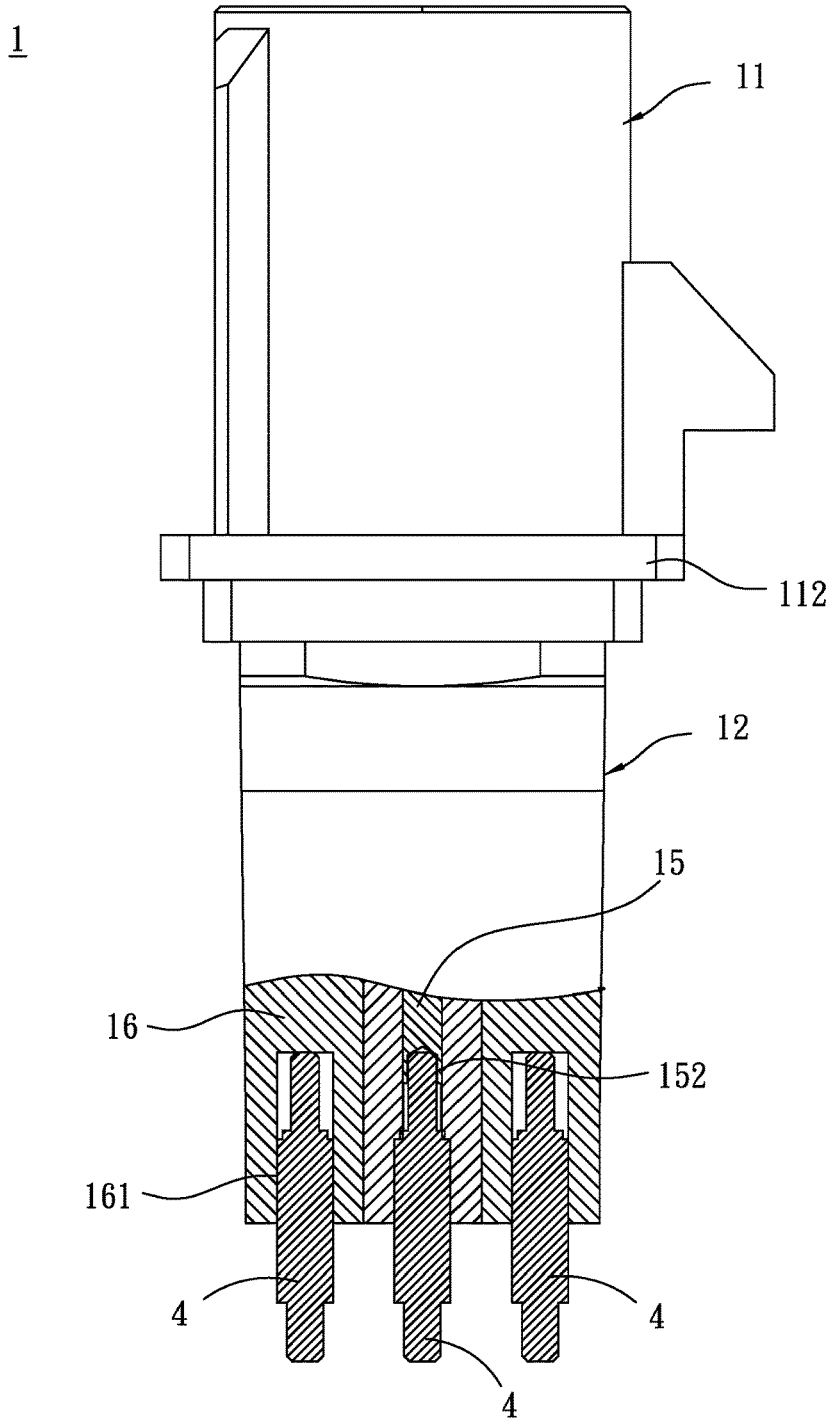
FIG. 7 is a sectional assembly view of the connector module in accordance with the fourth embodiment of the present invention.

Referring to FIGS. 6 and 7, an elevational view and a sectional assembly view of a connector module in accordance with a fourth embodiment of the present invention are shown. In this fourth embodiment, electrically conducting lead rods 4 are connected in parallel to the split end portion 152 of the conductor element 15. Further, the connection fitting 16 comprises a plurality of plug holes 161. The lead rods 4 are respectively plugged into the respective plug holes 161. As illustrated in FIG. 7, the lead rods 4 in the plug holes 161 are not conducted to the conductor element 15. Further, the conducting seat 2 comprises a plurality of conducting terminals 22. As illustrated in FIG. 6, these conducting terminals 22 are conducting layers corresponding to the respective lead rods 4. The lead rods 4 in the plug holes 161 are adapted for grounding.

Figure 8:
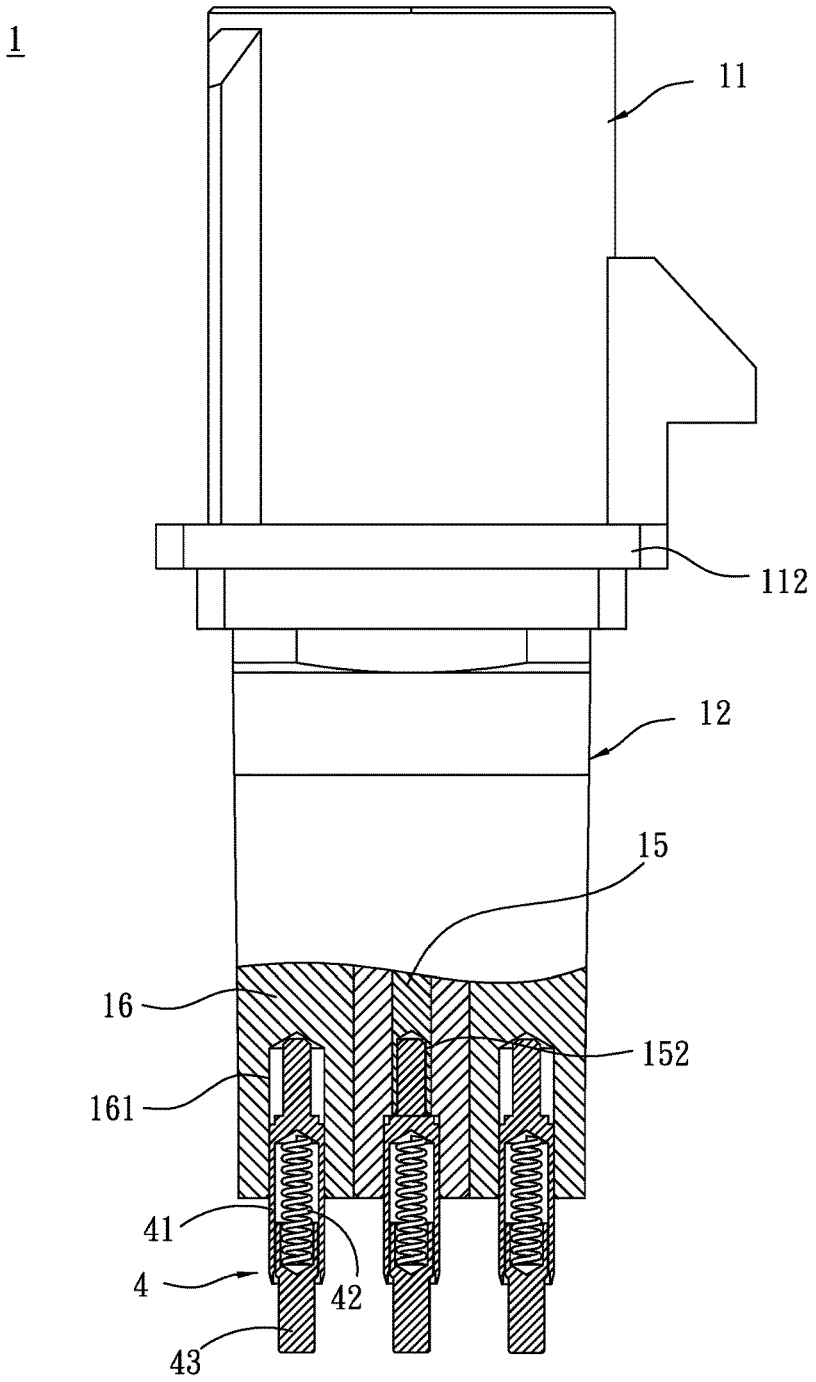
FIG. 8 is a sectional assembly view of the connector module in accordance with a fifth embodiment of the present invention.

Referring to FIG. 8, a connector module in accordance with a fifth embodiment of the present invention is shown. This fifth embodiment is substantially similar to the aforesaid fourth embodiment with the exception that each lead rod 4 defines therein an axial hole 41 that accommodates therein an elastic member 42 and a movable rod 43. In this embodiment, the elastic member 42 is a spring. The movable rod 43 is a metal rod, having one end thereof supported on the elastic member 42 inside the axial hole 41 and an opposite end thereof extended out of the respective lead rod 4. Thus, the movable rod 43 is axially movably supported on the elastic member 42 for connection to the conducting seat 2 flexibly.

Figure 9:
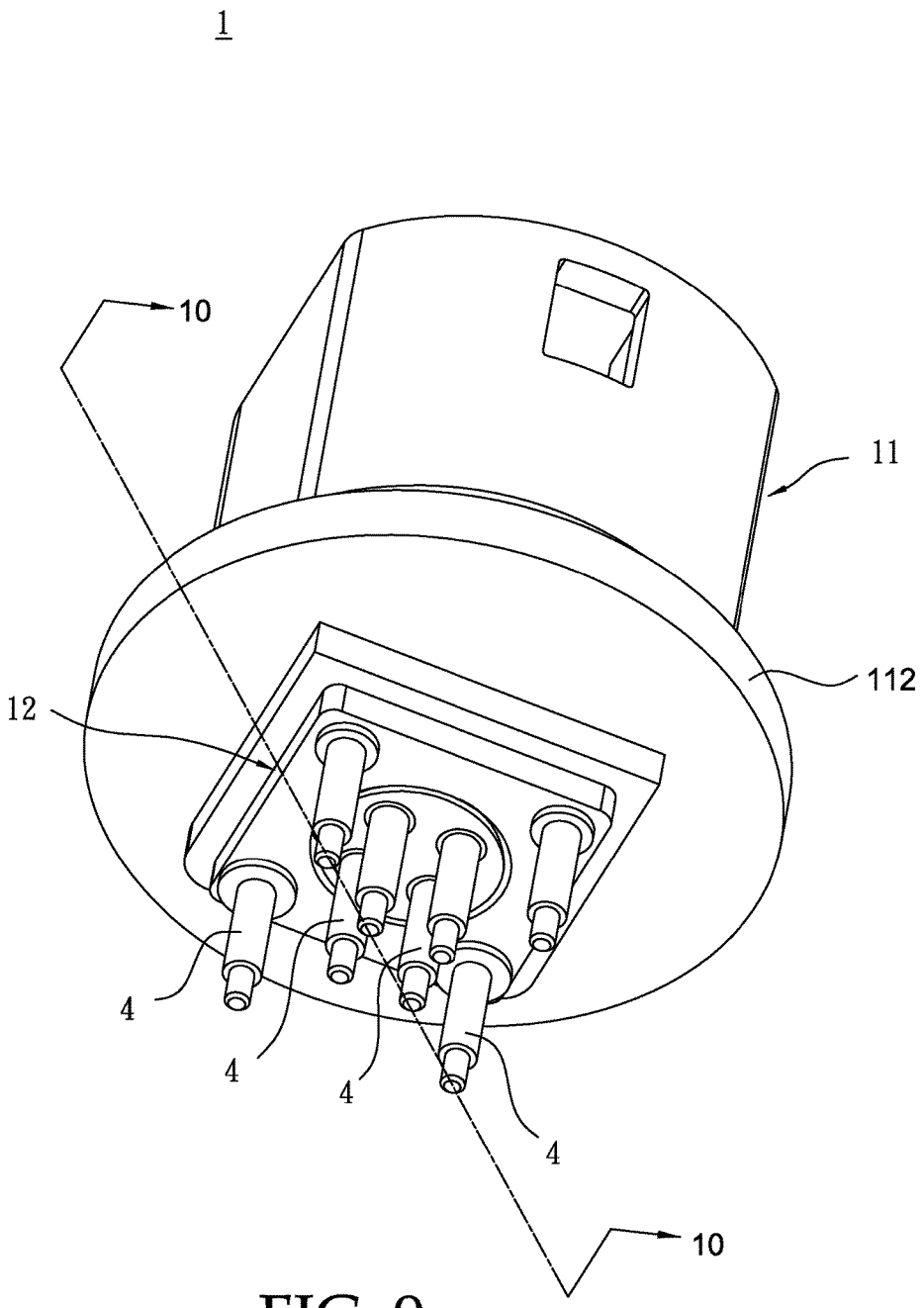
FIG. 9 is an oblique bottom elevational view of a connector module in accordance with a sixth embodiment of the present invention.
Figure 10:
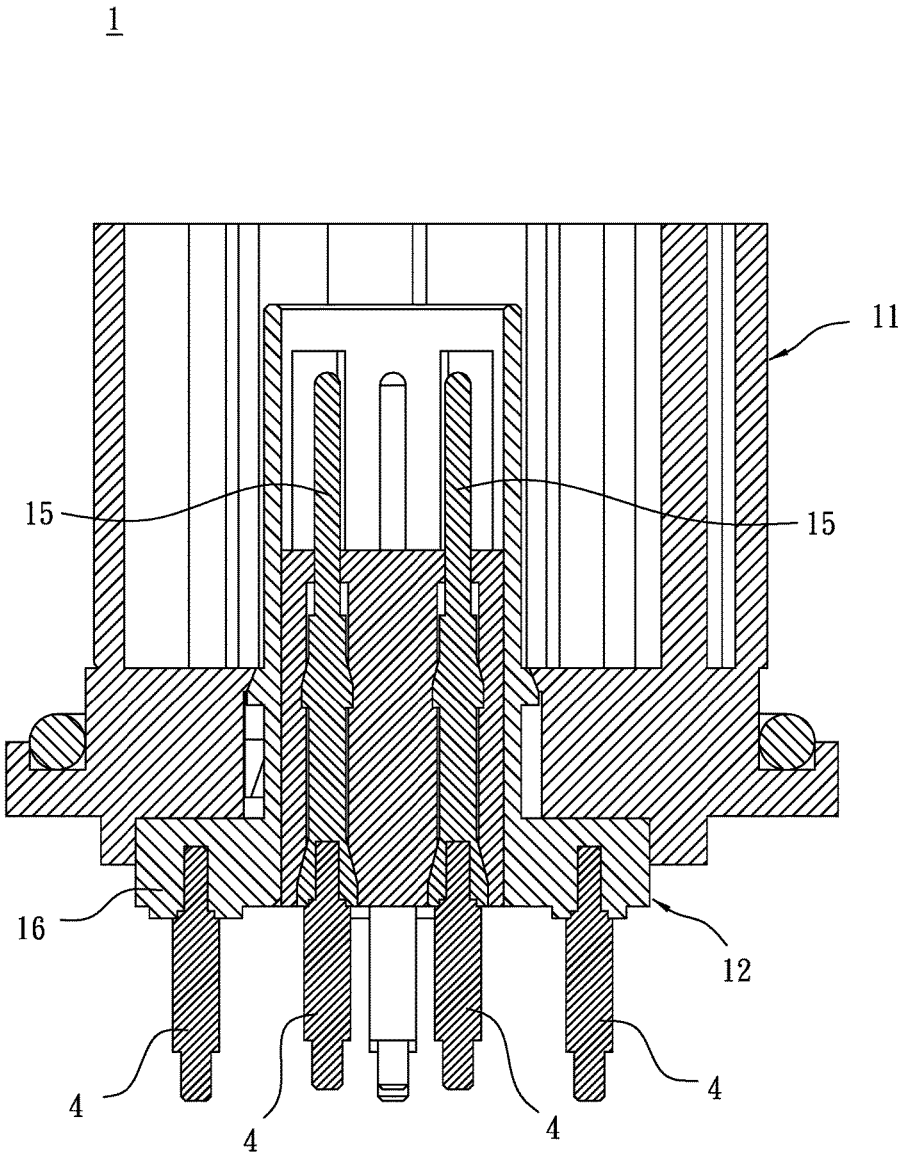
FIG. 10 is a sectional assembly view of the connector module in accordance with the sixth embodiment of the present invention.

Referring to FIGS. 9 and 10, a connector module in accordance with a sixth embodiment of the present invention is shown. In this sixth embodiment, the connector 1 has multiple signal transmission ability. As illustrated in FIG. 10, the connector 1 has mounted therein a plurality of conductor elements 15 for transmitting different signals to the conducting seat 2.

Although particular embodiments of the invention have been described in detail for purposes of illustration, various modifications and enhancements may be made without departing from the spirit and scope of the invention. Accordingly, the invention is not to be limited except as by the appended claims.

What the invention claimed is:

1. A connector module, comprising:

a connector, comprising:

a housing comprising an insertion hole axially cut through opposing front and rear ends thereof, a flange extended around an outer perimeter thereof and an engagement groove defined within said flange;

a main holder member connected to said housing, said main holder member comprising a connection barrel located at one end thereof and mounted in said insertion hole of said housing, an engagement block extended around the periphery thereof and accommodated in said engagement groove and an accommodation chamber defined therein;

a waterproof gasket attached onto said connection barrel and squeezed in between said main holder member and said housing;

a subsidiary holder member mounted in said accommodation chamber of said main holder member, said subsidiary holder member comprising a center conductor hole axially cut through opposing front and rear end thereof and a connection tip located at the front end thereof;

a conductor element inserted into said center conductor hole, said conductor element comprising a split end portion located at a front end thereof and disposed in said connection tip;

a connection fitting connected to said connection tip of said subsidiary holder member to surround said connection tip; and a conducting seat for the connection of said connector, said conducting seat comprising a conducting board and at least one conducting terminal mounted to said conducting board and adapted for the connection of said connection fitting, said at least one conducting terminal being electrically coupled with said conducting board.

2. The connector module as claimed in claim 1, wherein the said flange of said housing exhibits a rectangular profile.

3. The connector module as claimed in claim 1, wherein said accommodation chamber defines therein a chamfer edge; said subsidiary holder member comprises a positioning groove extended around the periphery thereof and forced into engagement with said chamfer edge.

4. The connector module as claimed in claim 1, wherein said subsidiary holder member further comprises a locating seat defined in said center conductor hole; said conductor element further comprises a retaining groove forced into engagement with said locating seat.

5. The connector module as claimed in claim 1, wherein each said conducting terminal is a seat member comprising therein a conducting rod that is inserted into said split end portion.

6. The connector module as claimed in claim 1, wherein said housing further comprises a rectangular guard shell connected to the flange thereof to surround said main holder member.

7. The connector module as claimed in claim 1, wherein said flange and said rectangular guard shell of said housing are made in integrity.

8. The connector module as claimed in claim 1, further comprising an extension adapter, said extension adapter comprising:

a first connector electrically connectable to said connection fitting, said first connector comprising therein a conducting rod for insertion into said split end portion;

a second connector electrically connectable to said at least one conducting terminal, said second connector comprising a center conductor hole axially cut through opposing front and rear ends thereof; and an electrical wire electrically connected between said first connector and said second connector.

9. The connector module as claimed in claim 1, wherein said conductor further comprises a plurality of lead rods connected to said connection fitting for connection to one respective said conducting terminal.

10. The connector module as claimed in claim 9, wherein each said conducting terminal is a conducting layer.

11. The connector module as claimed in claim 9, wherein said connection fitting comprises a plurality of plug holes for receiving said lead rods to keep said lead rods apart from said conductor element; each said conducting layer of said conducting seat is a conducting layer for the connection of one respective said lead rod.

12. The connector module as claimed in claim 9, wherein each said lead rod comprises an axial hole having accommodated therein an elastic member and a movable rod, said movable rod having one end thereof supported on said elastic member in said axial hole of the respective said lead rod and an opposite end thereof extended out of said axial hole of the respective said lead rod.

* * * * *